US007212776B2

(12) United States Patent
Takagi et al.

(10) Patent No.: US 7,212,776 B2
(45) Date of Patent: May 1, 2007

(54) FIXING BELT HAVING HIGHER HARDNESS AT A REAR SURFACE THAN AT A FRONT SURFACE

(75) Inventors: Masao Takagi, Numazu (JP); Goki Inukai, Kuki (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/962,540

(22) Filed: Oct. 13, 2004

(65) Prior Publication Data

US 2005/0084303 A1 Apr. 21, 2005

(30) Foreign Application Priority Data

Oct. 15, 2003 (JP) ..... 2003-355491

(51) Int. Cl.
*G00G 15/20* (2006.01)

(52) U.S. Cl. ..... 399/333

(58) Field of Classification Search ..... 399/333
See application file for complete search history.

(56) References Cited

U.S. PATENT DOCUMENTS 2,372,202 A * 3/1945 Hensel et al. ..... 428/566
2,569,367 A * 9/1951 Bradner et al. ..... 425/471
4,919,491 A * 4/1990 Heideman ..... 301/126
5,105,222 A * 4/1992 Ohta et al. ..... 399/159
2003/0185606 A1* 10/2003 Takagi et al. ..... 399/329
2004/0190959 A1* 9/2004 Kikuchi et al. ..... 399/333

FOREIGN PATENT DOCUMENTS

| | | |
|---|---|---|
| JP | 4-9492 | 1/1992 |
| JP | 10-60680 | 3/1998 |
| JP | 10-254263 | 9/1998 |
| JP | 2000-026990 | 1/2000 |
| JP | 2000-242108 | 9/2000 |
| JP | 2001-006868 | 1/2001 |
| JP | 2002-148975 | 5/2002 |
| JP | 2002-206188 | 7/2002 |
| JP | 2003-57981 | 2/2003 |
| JP | 2003-239093 | 8/2003 |

OTHER PUBLICATIONS

JP Office Action—Notification of Reasons for Rejection, dated Jul. 11, 2006.
The Journal of the Surface Finishing Society of Japan, 1989, vol. 40, No. 3.
Japanese Prior Art Document List dated Oct. 17, 2006, Application No. 2003-355491.

* cited by examiner

*Primary Examiner*—Quana Grainger
(74) *Attorney, Agent, or Firm*—Westerman, Hattori, Daniels & Adrian, LLP.

(57) ABSTRACT

A fixing belt for fixing the toner image on a recording medium includes an electroformed nickel endless belt body. The belt body exhibits hardness higher at the rear surface than at the front surface after heated at 350° C.

17 Claims, 4 Drawing Sheets

FIXING BELT HAVING HIGHER HARDNESS AT A REAR SURFACE THAN AT A FRONT SURFACE

CROSS-REFERENCE TO RELATED APPLICATIONS

This application is based upon and claims the benefit of priority from prior Japanese Patent Application No. 2003-355491, filed Oct. 15, 2003, the entire contents of which are incorporated herein by reference.

BACKGROUND OF THE INVENTION

1. Field of the Invention

The present invention relates to a fixing belt comprising an electroformed nickel endless belt body, used in a fixing section of an image-forming apparatus such a facsimile or a laser beam printer.

2. Description of the Related Art

As is well known in the art, a belt fixing system using an endless fixing belt (an endless belt or an endless film) in place of a fixing roller is employed in an image-forming apparatus in compliance with the demands for the miniaturization and the energy saving of the image-forming apparatus and for the increased speed in the printing and copying operation. The fixing belt is thin, and therefore can substantially directly heat the toner image on the recording medium by the heating from the inside the thin fixing belt only through the thin belt and fix the toner image. Accordingly, the fixing belt is advantageous in that it can shorten the waiting time after the turning on of the power source.

Use of an endless nickel belt prepared by electroforming as a belt body of the fixing belt is disclosed in, for example, Japanese Patent Disclosure (Kokai) No. 2002-148975. This patent document teaches that an endless nickel belt containing 0.01 to 0.1 mass % of carbon is prepared by the electroforming. Also, Japanese Patent Disclosure No. 2003-57981 discloses a belt fixing system using a halogen lamp as a heating source.

However, the conventional fixing belt having an electroformed nickel belt body fails to exhibit a sufficient resistance to thermal fatigue at high temperatures, and is poor in its durability. More specifically, in the case of the belt fixing system, the rear surface of the belt body of the fixing belt is deteriorated by heat so as to generate cracks, leading to the problem that the belt body is broken.

BRIEF SUMMARY OF THE INVENTION

Accordingly, an object of the present invention is to provide a fixing belt of a high durability, in which heat deterioration of an electroformed nickel belt body is prevented, thereby improving resistance to thermal fatigue of the fixing belt at high temperatures.

According to a first aspect of the present invention, there is provided a fixing belt for fixing a toner image on a recording medium, comprising an endless belt body, the endless belt body being formed of electroformed nickel, having a front surface and a rear surface, and exhibiting hardness higher at the rear surface than at the front surface after heated at 350° C.

In the present specification, with respect to the belt body, the term "rear surface" denotes the inner circumferential surface of the belt body, and the term "front surface" denotes the outer circumferential surface of the belt body.

According to a second aspect of the present invention, there is provided a fixing belt for fixing a toner image on a recording medium, comprising an endless belt body, the endless belt body being formed of electroformed nickel, having a front surface and a rear surface, and exhibiting hardness higher at the rear surface than at the front surface, wherein difference in hardness between the front surface and the rear surface, after heated, is larger than that between the front surface and the rear surface of the belt body before heating.

In the present specification, with respect to the belt body, the expression "difference in hardness between the front surface and the rear surface" denotes the value obtained by subtracting the value of the hardness at the front surface of the belt body from the value of the hardness at the rear surface of the belt body. The case where the difference in hardness between the front surface and the rear surface of the belt body after heated is larger than the difference in hardness between the front surface and the rear surface of the belt body before heating includes a case where the difference in hardness between the front surface and the rear surface of the belt body after heated at 300° C. is larger than the difference in hardness between the front surface and the rear surface of the belt body after heated at 220° C., and a case where the difference in hardness between the front surface and the rear surface of the belt body after heated at 350° C. is larger than the difference in hardness between the front surface and the rear surface of belt body after heated at 300° C., considering the heat life required for the fixing belt.

According to a third aspect of the present invention, there is provided a fixing belt for fixing a toner image on a recording medium, comprising an endless belt body, the endless belt body being formed of electroformed nickel, having a front surface and a rear surface, and exhibiting hardness higher at the rear surface than at the front surface, wherein hardness of the front surface after heated is higher than before heating.

Further, according to a fourth aspect of the present invention, there is provided a fixing belt for fixing a toner image on a recording medium, comprising an endless belt body, the endless belt body being formed of electroformed nickel, having a front surface and a rear surface, and exhibiting hardness higher at the rear surface than at the front surface, wherein hardness at the rear surface after heated is higher than before heating.

In the fixing belt of the present invention, it is preferred that the belt body contains phosphorus, and it is more preferred that the belt body contains phosphorus in an amount larger in the rear surface region than in the front surface region. In the present invention, it is particularly preferred that the phosphorus content in the belt body is smaller than 0.4 mass %.

DETAILED DESCRIPTION OF THE INVENTION

Various embodiments of the present invention will now be described with reference to the accompanying drawings.

Figure 1:
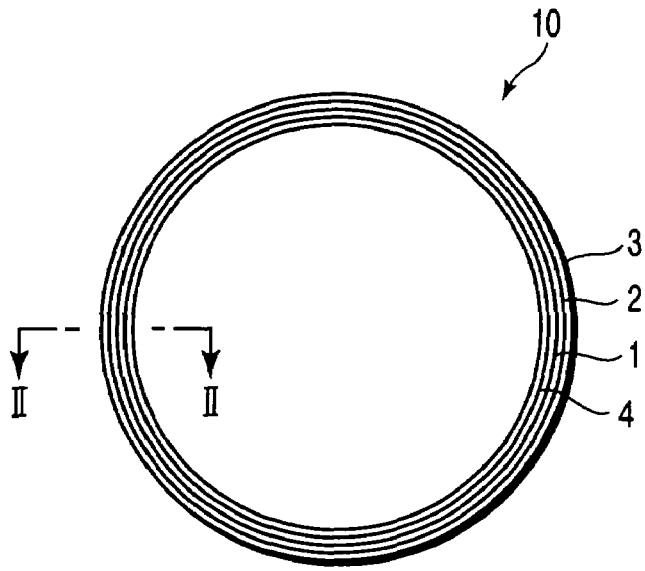
FIG. 1 is a front view illustrating a fixing belt according to an embodiment of the present invention.
Figure 2:
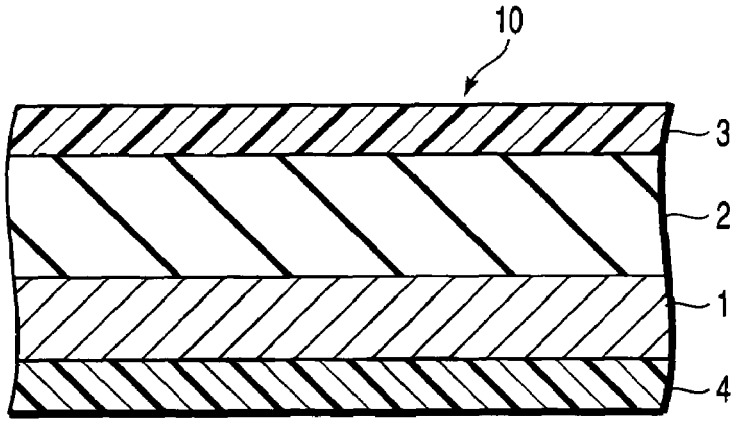
FIG. 2 is an enlarged view illustrating a portion of the cross section taken along the line II—II of FIG. 1.

FIG. 1 is a front view schematically illustrating a toner fixing belt 10 according to an embodiment of the present invention, and FIG. 2 is an enlarged view illustrating a portion of the cross section taken along the line II—II shown in FIG. 1.

The fixing belt 10 comprises an endless belt body 1 formed of electroformed nickel. As shown in FIGS. 1 and 2, the fixing belt 10 usually has a releasing layer 3 such as a fluororesin layer coated, directly or through an elastic layer 2 such as a silicone rubber layer, on the outer circumferential surface (front surface). On the inner circumferential surface of the belt body 1, a sliding layer 4 may formed as required. A primer layer (not illustrated) may be provided between the belt body 1 and the elastic layer 2, between the elastic layer 2 and the releasing layer 3, or between the belt body 1 and the sliding layer 4, for securing the bonding between the adjacent layers of the fixing belt 10. Use may be made of a known material such as a silicone material, an epoxy material, or a polyamideimide material for forming the primer layer. The thickness of the primer layer may be about 1 μm to 30 μm.

In the case of employing an electromagnetic induction heating system, it is desirable that the thickness of the belt body 1 is larger than the skin depth represented by the formula:

$$\sigma=503\times(\rho/f\mu)^{1/2}$$

where σ denotes the skin depth (m), f denotes the frequency (Hz) of the exciting circuit, μ denotes the permeability, and ρ denotes the resistivity (Ωm). The thickness of the belt body 1 is preferably 1 μm to 100 μm. The skin depth represents the absorption depth of the electromagnetic wave used for the electromagnetic induction heating. The intensity of the electromagnetic wave in the portion deeper than the skin depth becomes 1/e or less and, thus, almost all the energy is absorbed before reaching the skin depth. If the thickness of the belt body is smaller than 1 μm, the belt body fails to absorb almost all the electromagnetic energy so as to lower the efficiency. On the other hand, if the thickness of the belt body exceeds 100 μm, the rigidity of the belt increases, and the flexibility is lowered. It follows that the flexing properties of the belt body tend to be impaired, with the result that the belt body is rendered unsuitable for use in the fixing belt.

On the other hand, where the belt is used in a belt fixing system using a halogen heater as a heating source, the thickness of the belt body is usually 10 μm to 100 μm, preferably 15 μm to 80 μm, and more preferably 20 μm to 60 μm in order to decrease the heat capacity of the fixing belt, improving the quick starting properties. The thickness of the belt body is most preferably 30 μm to 50 μm in view of the balance among, for example, the heat capacity, the heat conductivity, the mechanical strength, and the flexibility. Where the belt body is used in a fixing belt for an electrophotographic copying machine, the width of the belt body may be determined appropriately in accordance with the width of a recording medium such as recording paper sheet.

The belt body 1 can be prepared in general by an electroforming method using a nickel electrodepositing bath, such as a Watts bath containing nickel sulfate or nickel chloride as a main component, or a sulfamate bath containing nickel sulfamate as a main component. Electroforming is a process in which a relatively thick metal film is electrodeposited over the surface of a mandrel, followed by detaching the electrodeposited film from the mandrel so as to obtain a desired article of the belt body. To obtain the belt body 1, a cylinder made of, e.g., stainless steel, brass or aluminum may be used as the mandrel, and an electrodeposited nickel film can be formed over the surface of the cylinder, using a nickel electrodepositing bath. Where the mandrel is formed of a nonconductive material such as a silicone resin or gypsum, electric conductivity may be imparted thereto by using graphite, a copper powder, or silver mirror, or by employing a sputtering method. Where electroforming is conducted on a metal mandrel, it is desirable to apply a detachment-facilitating treatment to the mandrel by forming a releasing film such as an oxide film, a compound film or a coated film of a graphite powder on the surface of the mandrel, in order to facilitate the detachment of the electroformed nickel film from the mandrel.

The nickel electrodepositing bath contains a nickel ion source, an anode dissolving agent, a pH buffering agent and other additives. The nickel ion source includes, for example, nickel sulfamate, nickel sulfate and nickel chloride. In the case of a Watts bath, nickel chloride acts as the anode dissolving agent. In the case of other nickel electrodepositing baths, ammonium chloride or nickel bromide, for example, is used as the anode dissolving agent. The nickel electrodeposition is usually carried out at a pH value of 3.0 to 6.2. In order to set the pH at a desired value within the range noted above, a pH buffering agent such as boric acid, formic acid or nickel acetate is used. The other additives include, for example, a brightener, a pit preventing agent and an inner stress reducing agent, which are intended to achieve the smoothening, the pit prevention, the formation of fine crystals, and the reduction of the residual stress.

It is desirable to use a nickel sulfamate bath as the nickel electrodepositing bath. As an example, the sulfamate bath may contain 300 to 600 g/L of nickel sulfamate tetrahydrate, 0 to 30 g/L of nickel chloride, 20 to 40 g/L of boric acid, an appropriate amount of a surfactant, and an appropriate amount of a brightener. The pH value of the sulfamate bath is desirably set at 3.5 and 4.5. The temperature of the sulfamate bath is desirably set at 40 to 60° C. Further, the current density is desirably set at 0.5 and 15 A/dm$^2$. In the case of a high concentration bath, the current density is desirably set at 3 and 40 A/dm$^2$.

In one embodiment of the present invention, the hardness at the rear surface of the belt body can be made higher than the hardness at the front surface of the belt body after heated, by carrying out the electroforming process under the conditions given above, with phosphorus added to the nickel electrodepositing bath, particularly, the sulfamate bath. When electroforming is performed by using such nickel electrodepositing bath, phosphorus is contained in a larger amount in the nickel skin film precipitated first on the surface of the mandrel, and the phosphorus content is rendered relatively low in the nickel skin film precipitated later, though the detailed mechanism of the this phenomenon has not yet been clarified. As a result, the belt body thus obtained permits effectively suppressing the lowering in the hardness of the rear surface caused by heating. It follows that, even after heated at 350° C., the belt body can maintain the relationship that the hardness of the rear surface is higher than the hardness of the front surface so as to improve the resistance to the thermal fatigue.

Also, in another aspect of the present invention, it is possible to further improve the resistance to the thermal fatigue in the case where the hardness at the rear surface of the belt body is higher than the hardness at the front surface of the belt body, and the difference in hardness between the front surface and the rear surface of the belt body after heated is larger than the difference in hardness between the front surface and the rear surface of the belt body before heating. The case where the difference in hardness between the front surface and the rear surface of the belt body after heated is larger than the difference in hardness between the front surface and the rear surface of the belt body before heating includes, for example, a case where the difference in hardness between the front surface and the rear surface of the belt body after heated at 300° C. is larger than the difference in hardness between the front surface and the rear surface of the belt body after heated at 220° C., and a case where the difference in hardness between the front surface and the rear surface of the belt body after heated at 350° C. is larger than the difference in hardness between the front surface and the rear surface of the belt body after heated at 300° C. Further, it has also been found in the present invention that the resistance to the thermal fatigue can be further improved in a case where, in addition to the relationship in hardness between the front surface and the rear surface of the belt body noted above, the hardness at the front surface of the belt body after heated is higher than the hardness at the front surface of the unheated belt body, and a case where, in addition to the relationship in hardness between the front surface and the rear surface of the belt body noted above, the hardness at the rear surface of the belt body after heated is higher than the hardness at the rear surface of the unheated belt body.

Phosphorus can be co-precipitated by adding phosphorus in the form of a water soluble salt of a phosphorus-containing acid, such as sodium hypophosphite, to the nickel electrodepositing bath. The hypophosphite can be added at a concentration of, for example, 20 to 200 mg/L. It is preferred that the electroformed nickel belt body of the present invention contains phosphorus in an amount smaller than 0.4 mass %. Usually, the phosphorus content is not lower than 0.04 mass %. The present inventors have found for the first time that the resistance to the thermal fatigue of the fixing belt body can be markedly improved by incorporating therein such a small amount of phosphorus.

The fixing belt is heated from the inside. Where a halogen lamp is used as the heating source, the belt body is heated in some cases to 200° C. or higher. Also, in the case of the heating by an electromagnetic induction heating system, the belt body is heated in some cases to 300° C. or higher. The heating temperature of 220° C. that is considered in the present invention is the temperature including an allowance with respect to the temperature of 200° C. noted above and. Also, the heating temperature of 350° C. that is considered in the present invention is the temperature including an allowance with respect to the temperature of 300° C. noted above. Also, in the present invention, "unheated" or "before heating" denotes the state that the belt body has been put under the ambient temperature. The ambient temperature may include the temperature under which the belt body has been placed during the period between the time immediately after the manufacture of the belt body by the electroforming method and the time immediately after the manufacture of the fixing belt by using the belt body. In general, the ambient temperature is at most 100° C.

Some Examples of the present invention will now be described. Needless to say, the scope of the present invention is not limited by the following Examples.

EXAMPLE 1

An aqueous solution containing 500 g/L of nickel sulfamate tetrahydrate and 35 g/L of boric acid was prepared and put in a container loaded with an activated carbon. Then, electrolytic refining was carried out at a low current while filtering the aqueous solution by using a 0.5 μm filter. Then, the activated carbon was taken out and a required amount of a pit preventing agent was added to the aqueous solution. Thereafter, 0.3 g/L of trisodium naphthalene-1,3,6-trisulfonate as a primary brightener, 140 mg/L of 2-butyne-1,4-diol as a secondary brightener and 20 mg/L of sodium hypophosphite monohydrate were added, preparing a desired sulfamate bath (electrolytic bath) as shown in Table 1.

Electroforming was performed at a prescribed bath temperature by using the above electrolytic bath with a stainless steel cylindrical mandrel having an outer diameter of 34 mm used as a cathode, thus forming an electrodeposited film having a thickness of 50 μm on the outer circumferential surface of the mandrel. During-the electroforming process, the current density was set at 10.5 A/dm$^2$. After washed with a deionized water, the electrodeposited film was detached from the mandrel, providing an electroformed nickel belt body having an inner diameter of 34 mm and a thickness of 50 μm

EXAMPLES 2–5 AND COMPARATIVE EXAMPLES 1–3

Electroformed nickel belt bodies, which had an inner diameter of 34 mm and a thickness of 50 μm, were prepared as in Example 1, except that electrolytic baths having the compositions as shown in Table 1 were used.

The phosphorus content was analyzed by using an ICP emission spectrometer for the electroformed nickel belt bodies of Examples 1–5 and Comparative Examples 1–3. The results are as shown also in Table 1.

TABLE 1

Composition of Sulfamate Bath and Phosphorus Content of Belt Body

| | Nickel Sulfamate Tetrahydrate | Boric Acid | Primary Brightener | Secondary Brightener | Sodium Hypophosphite | Phosphorus Content |
|---|---|---|---|---|---|---|
| Ex. 1 | 500 g/L | 35 g/L | 0.3 g/L | 140 mg/L | 20 mg/L | 0.04 mass % |
| Ex. 2 | 500 g/L | 35 g/L | 0.3 g/L | 140 mg/L | 40 mg/L | 0.08 mass % |
| Ex. 3 | 500 g/L | 35 g/L | 0.3 g/L | 140 mg/L | 60 mg/L | 0.12 mass % |
| Ex. 4 | 500 g/L | 35 g/L | 0.3 g/L | 140 mg/L | 100 mg/L | 0.20 mass % |
| Ex. 5 | 500 g/L | 35 g/L | 0.3 g/L | 140 mg/L | 190 mg/L | 0.38 mass % |
| Comp. Ex. 1 | 500 g/L | 35 g/L | 0.3 g/L | 140 mg/L | 0 | 0 |
| Comp. Ex. 2 | 500 g/L | 35 g/L | 0.5 g/L | 167 mg/L | 0 | 0 |
| Comp. Ex. 3 | 500 g/L | 35 g/L | 0.5 g/L | 200 mg/L | 0 | 0 |

Test 1

In order to confirm the state of the thermal deterioration at the front surface and the rear surface of the electroformed nickel belt body of the present invention in terms of the change in hardness, the hardnesses at the front surface and the rear surface of each of the belt bodies of Examples 1 to 5 and Comparative Examples 1 to 3 were measured (micro Vickers hardness measured by using MVK-G1 manufactured by K.K. Akashi) after the thermal history (unheated or heated at 220° C., 300° C. or 350° C. for 2 hours). Tables 2 and 3 show the results. In measuring the hardness, the load was set at 100 gf, and the load retention time was set at 15 seconds. Table 2 shows the hardness at the front surface of the belt body, and Table 3 shows the hardness at the rear surface of the belt body.

TABLE 2

Hardness at Front Surface

| Heating | Example | | | | | Comp. Example | | |
|---|---|---|---|---|---|---|---|---|
| Temp. | 1 | 2 | 3 | 4 | 5 | 1 | 2 | 3 |
| Unheated | 334.0 | 333.0 | 337.3 | 343.0 | 366.3 | 319.7 | 349.3 | 375.2 |
| 220° C. | 366.7 | 368.3 | 374.3 | 376.7 | 401.3 | 341.7 | 389.5 | 423.2 |
| 300° C. | 358.3 | 370.7 | 366.7 | 375.3 | 411.3 | 349.7 | 381.0 | 408.7 |
| 350° C. | 355.7 | 360.0 | 361.7 | 370.0 | 406.0 | 322.7 | 327.0 | 327.3 |

TABLE 3

Hardness at Rear Surface

| Heating | Example | | | | | Comparative Ex. | | |
|---|---|---|---|---|---|---|---|---|
| Temp. | 1 | 2 | 3 | 4 | 5 | 1 | 2 | 3 |
| Unheated | 356.3 | 357.3 | 362.0 | 369.3 | 381.3 | 348.7 | 373.0 | 399.3 |
| 220° C. | 390.3 | 392.0 | 403.7 | 407.7 | 420.7 | 375.7 | 421.3 | 442.7 |
| 300° C. | 389.0 | 398.0 | 402.3 | 416.3 | 439.0 | 350.0 | 387.7 | 385.7 |
| 350° C. | 390.3 | 401.0 | 402.3 | 419.0 | 444.0 | 273.3 | 266.3 | 250.0 |

Figure 4:
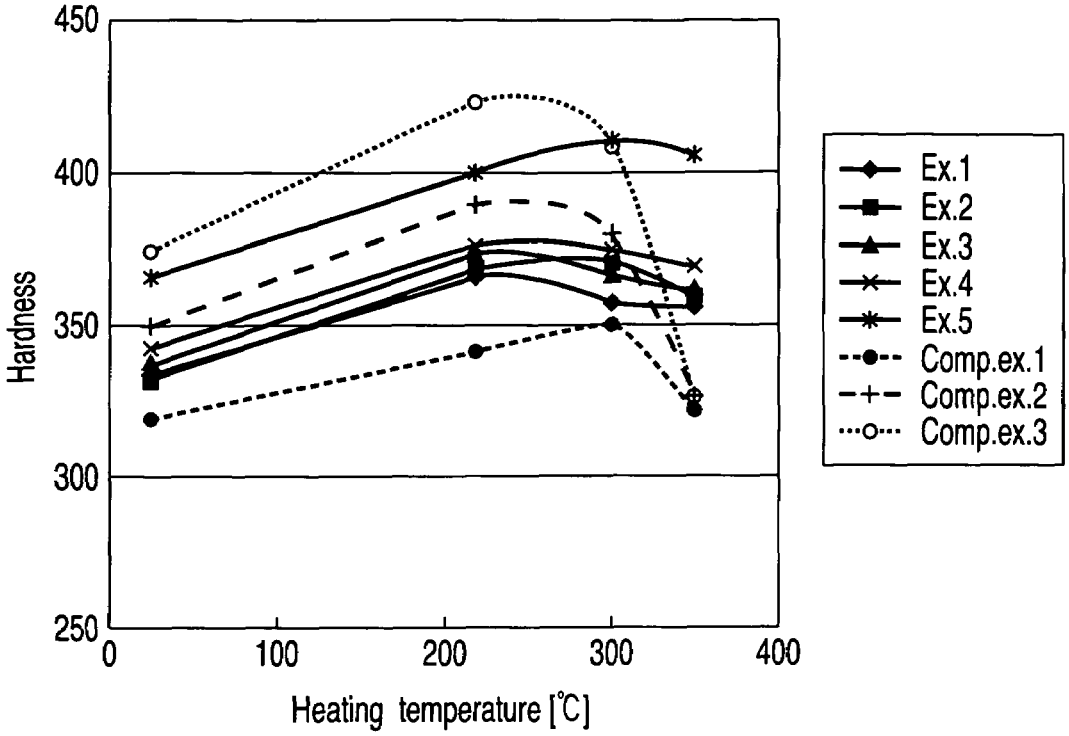
FIG. 4 is a graph showing the relationship between a heating temperature of the belt body and the hardness at the front surface of the belt body after heated for 2 hours in respect of the belt body of each of Examples 1 to 5 and Comparative Examples 1 to 3, which are described herein later in detail.
Figure 5:
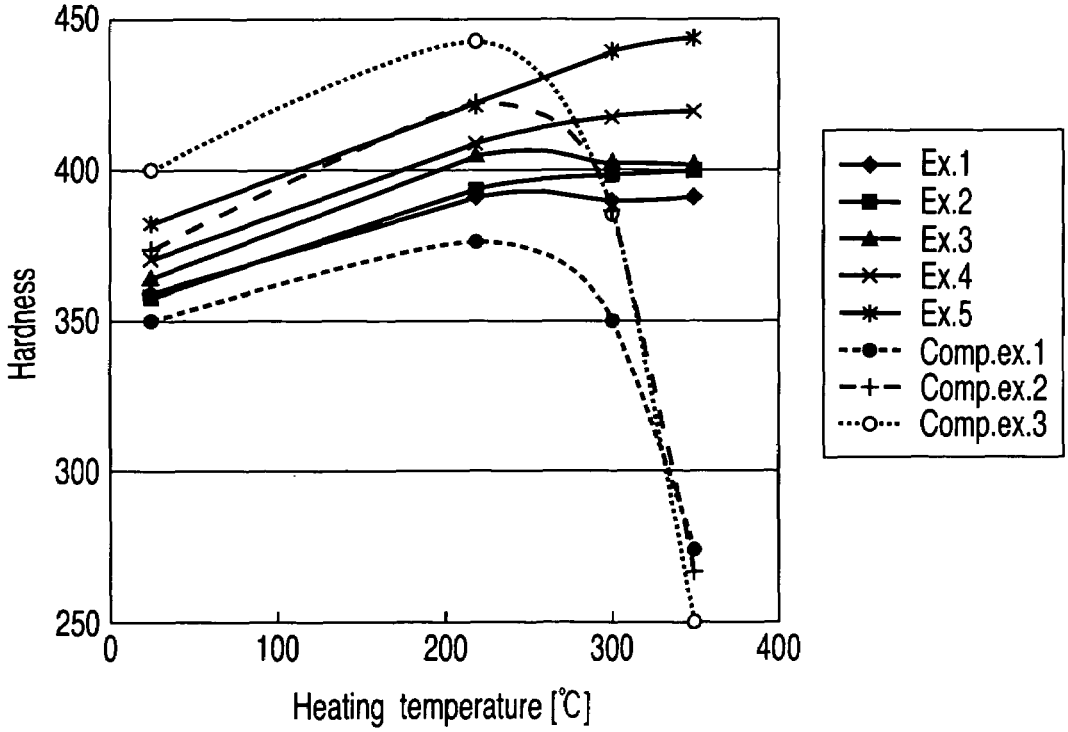
FIG. 5 is a graph showing the relationship between a heating temperature of the belt body and the hardness at the rear surface of the belt body after heated for 2 hours in respect of the belt body of each of Examples 1 to 5 and Comparative Examples 1 to 3, which are described herein later in detail.

The data shown in Tables 2 and 3 are given in the graphs of FIGS. 4 and 5, respectively.

Figure 6:
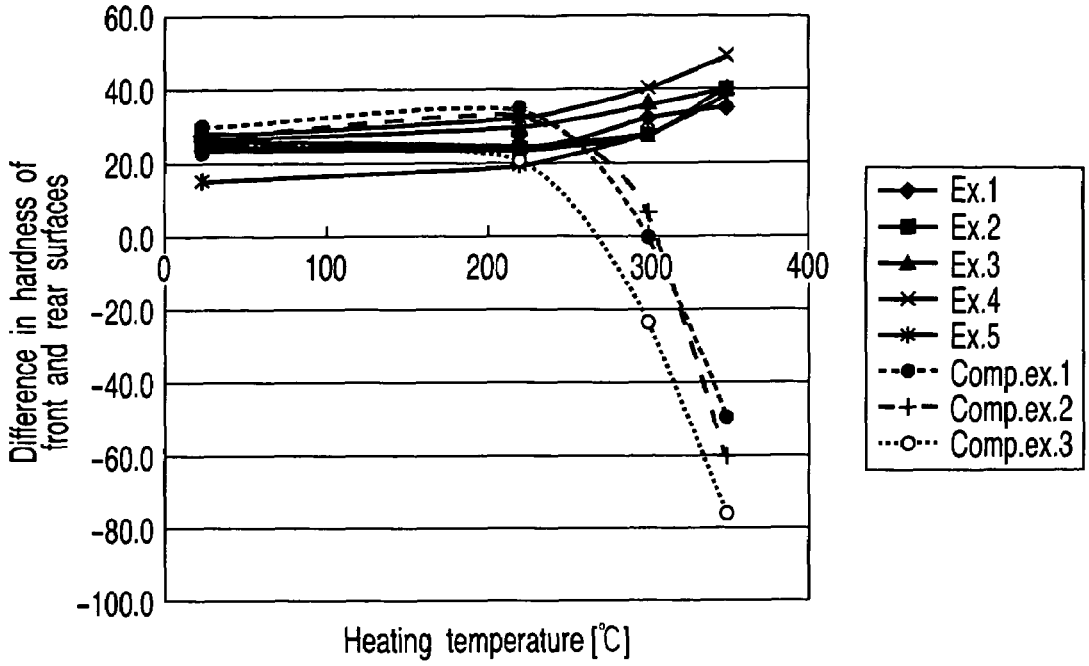
FIG. 6 is a graph showing the relationship between a heating temperature of the belt body and the difference in hardness between the front surface and the rear surface of the belt body after heated for 2 hours in respect of the belt body of each of Examples 1 to 5 and Comparative Examples 1 to 3, which are described herein later in detail.

The difference in hardness between the rear surface and the front surface of each belt body (i.e., the value obtained by subtracting the hardness at the front surface of the belt body from the hardness at the rear surface of the belt body) was calculated on the basis of the data shown in Tables 2 and 3. Table 4 shows the result. Also, the result shown in Table 4 is given as a graph in FIG. 6.

Figure 7:
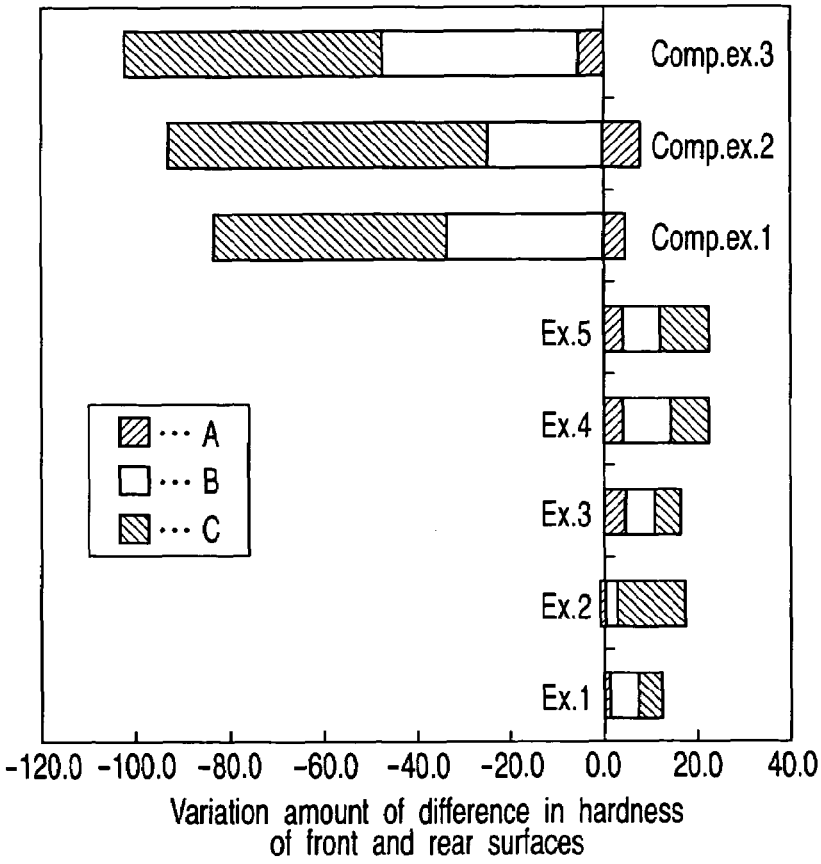
FIG. 7 is a graph showing the amount of change in the difference in hardness between the front surface and the rear surface of the belt body of each of Examples 1 to 5 and Comparative Examples 1 to 3, which are described herein later in detail.

On the other hand, the amount of change in the difference in hardness between the front surface and the rear surface of the belt body was examined on the basis of the experimental data given in Table 4 so as to obtain the result shown in Table 5. To be more specific, Table 5 shows values A obtained by subtracting the difference in hardness between the front surface and the rear surface of the unheated belt body from the difference in hardness between the front surface and the rear surface of the belt body after heated at 220° C. Table 5 also shows values B obtained by subtracting the difference in hardness between the front surface and the rear surface of the belt body after heated at 220° C. from the difference in hardness between the front surface and the rear surface of the belt body after heated at 300° C. In addition, Table 5 shows values C obtained by subtracting the difference in hardness between the front surface and the rear surface of the belt body after heated at 3000° C. from the difference in hardness between the front surface and the rear surface of the belt body after heated at 350° C. The data shown in Table 5 is also shown as a graph in FIG. 7.

TABLE 4

Difference in Hardness between Front Surface and Rear surface

| Heating | Example | | | | | Comparative Ex. | | |
|---|---|---|---|---|---|---|---|---|
| Temp. | 1 | 2 | 3 | 4 | 5 | 1 | 2 | 3 |
| Unheated | 22.3 | 24.3 | 24.7 | 26.3 | 15.0 | 29.0 | 23.7 | 24.1 |
| 220° C. | 23.3 | 23.7 | 29.4 | 31.0 | 19.4 | 34.0 | 31.8 | 19.5 |
| 300° C. | 30.7 | 27.3 | 35.6 | 41.0 | 27.7 | 0.3 | 6.7 | −23.0 |
| 350° C. | 34.6 | 41.0 | 40.6 | 49.0 | 38.0 | −49.4 | −60.7 | −77.3 |

TABLE 5

Amount of Change in Difference in Hardness between Front Surface and Rear Surface

| | Example | | | | | Comparative Ex. | | |
|---|---|---|---|---|---|---|---|---|
| | 1 | 2 | 3 | 4 | 5 | 1 | 2 | 3 |
| A | 1.0 | −0.6 | 4.7 | 4.7 | 4.4 | 5.0 | 8.1 | −4.6 |
| B | 7.4 | 3.6 | 6.2 | 10.0 | 8.3 | −33.7 | −25.1 | −42.5 |
| C | 3.9 | 13.7 | 5.0 | 8.0 | 10.3 | −49.7 | −67.4 | −54.3 |

Incidentally, Table 5 shows that the changing amount A in the difference in hardness between the front surface and the rear surface of the belt body for Example 2 is −0.6. The value of −0.6 is based on errors in measuring the hardness at the front surface and the rear surface of the belt body.

Figure 8:
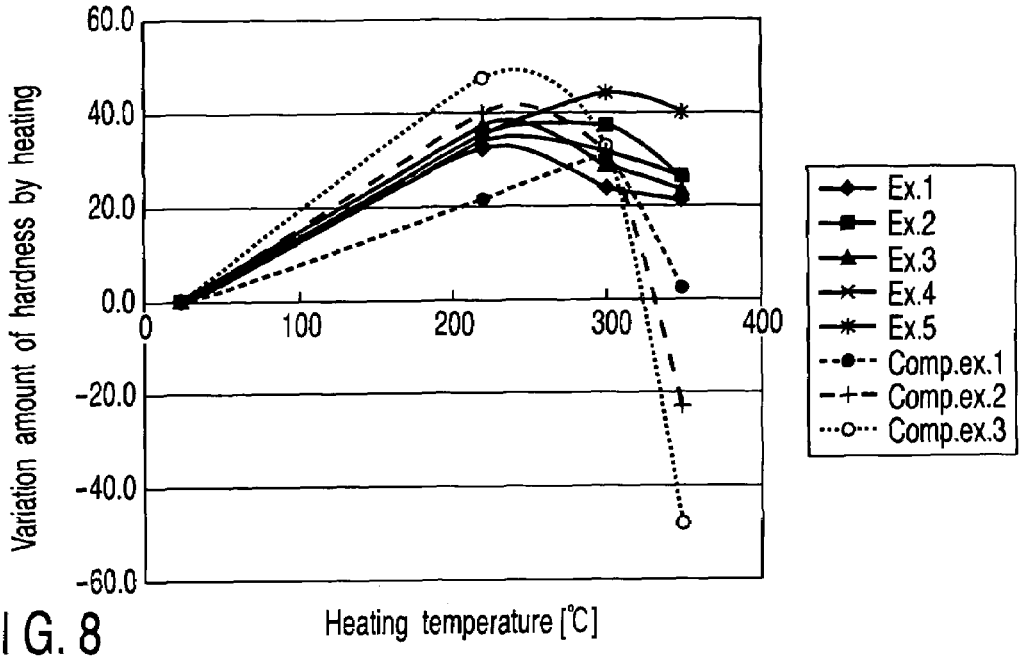
FIG. 8 is a graph showing the relationship between the heating temperature and the amount of change in the hardness of the front surface after heated for 2 hours relative to the unheated belt body in respect of the belt body of each of Examples 1 to 5 and Comparative Examples 1 to 3, which are described herein later in detail.
Figure 9:
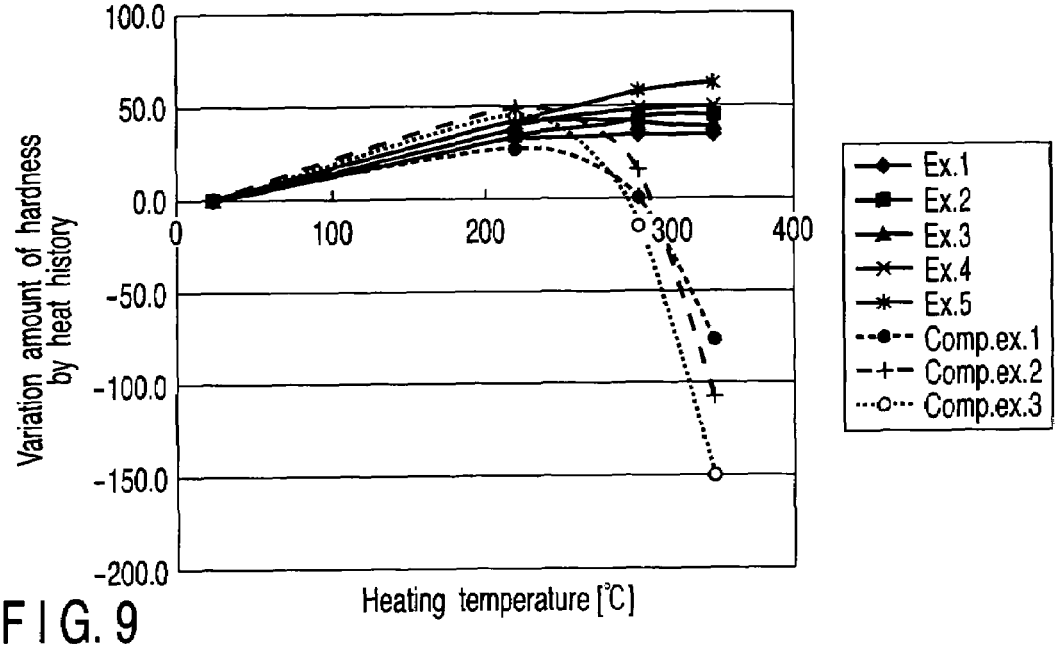
FIG. 9 is a graph showing the relationship between the heating temperature and the amount of change in the hardness of the rear surface after heated for 2 hours relative to the unheated belt body in respect of the belt body of each of Examples 1 to 5 and Comparative Examples 1 to 3, which are described herein later in detail.

Further, the amount of change in hardness at the front surface of the belt body after heated relative to the hardness at the front surface of the unheated belt body was calculated on the basis of the data given in Table 2. Table 6 shows the result. Likewise, the amount of change in hardness at the rear surface of the belt body after heated relative to the hardness at the rear surface of the unheated belt body was calculated on the basis of the data given in Table 3. Table 7 shows the result. FIG. 8 is a graph prepared on the basis of the data given in Table 6 and showing the relationship between the heating temperature for the heating carried out for 2 hours and the amount of change in hardness caused by the heating. Likewise, FIG. 9 is a graph prepared on the basis of the experimental data given in Table 7 and showing the relationship between the heating temperature for the heating carried out for 2 hours and the amount of change in hardness caused by the thermal history.

TABLE 6

Amount of Change in Hardness at Front Surface of Belt body after Heated relative to Value for Unheated Belt body

| Heating | Example | | | | | Comparative Ex. | | |
|---|---|---|---|---|---|---|---|---|
| Temp. | 1 | 2 | 3 | 4 | 5 | 1 | 2 | 3 |
| 220° C. | 32.7 | 35.3 | 37.0 | 33.7 | 35.0 | 22.0 | 40.2 | 48.0 |
| 300° C. | 24.3 | 37.7 | 29.4 | 32.3 | 45.0 | 30.0 | 31.7 | 33.5 |
| 350° C. | 21.7 | 27.0 | 24.4 | 27.0 | 39.7 | 3.0 | −22.3 | −47.9 |

TABLE 7

Amount of Change in Hardness on Rear surface of Belt body after Heated relative to Value for Unheated Belt body

| Heating | Example | | | | | Comparative Ex. | | |
|---|---|---|---|---|---|---|---|---|
| Temp. | 1 | 2 | 3 | 4 | 5 | 1 | 2 | 3 |
| 220° C. | 33.7 | 34.7 | 41.7 | 38.4 | 39.4 | 27.0 | 48.3 | 43.4 |
| 300° C. | 32.7 | 40.7 | 40.3 | 47.0 | 57.7 | 1.3 | 14.7 | −13.6 |
| 350° C. | 34.0 | 43.7 | 40.3 | 49.7 | 62.7 | −75.4 | −106.7 | −149.3 |

With respect to the belt body of the present invention, these results shown above clearly indicate the following:

1) The difference in hardness between the front surface and the rear surface of the belt body after heated at 350° C. for 2 hours is made smaller than zero (0) in all of the Comparative Examples. However, the hardness at the rear surface is not lowered by the deterioration by heat in the belt body of each of Examples 1 to 5 containing phosphorus as one of measures to prevent the hardness from being lowered (see Table 4 and FIG. 6).

2) The hardness at the rear surface of the belt body is higher than the hardness at the front surface of the belt body (see Tables 4 and 5 and FIGS. 6 and 7), and the difference in hardness between the front surface and the rear surface of the belt body after heated is larger than the difference in hardness between the front surface and the rear surface of the belt body before heating (see Tables 6 and 7 and FIGS. 8 and 9).

3) The difference in hardness between the front surface and the rear surface of the belt body after heated at 300° C. is larger than the difference in hardness between the front surface and the rear surface of the belt body after heated at 220° C. (see Table 5 and FIG. 7). For example, when it comes to the belt body of Example 1, the difference in hardness between the front surface and the rear surface of the belt body after heated at 300° C. is 30.7 (Table 4), and the difference in hardness between the front surface and the rear surface of the belt body after heated at 220° C. is 23.3 (Table 4). In other words, it can be understood that, even if the belt body is heated at temperatures not lower than 300° C., the amount of change in the difference in hardness between the front surface and the rear surface is on the positive side (see FIG. 7). This implies that, even heated at high temperatures not lower than 300° C., the difference in hardness between the front surface and the rear surface of the belt body after heated tends to be increased.

4) The difference in hardness between the front surface and the rear surface of the belt body after the heat treatment at 350° C. is larger than the difference in hardness between the front surface and the rear surface of the belt body after the heat treatment at 300° C. (see Table 5 and FIG. 7).

5) The hardness at the rear surface of the belt body is higher than the hardness at the front surface of the belt body (see Table 4 and FIG. 6), and the hardness at the front surface of the belt body after heated is markedly higher than the hardness at the front surface of the unheated belt body (see Table 6 and FIG. 8). Also, the hardness at the rear surface of the belt body is higher than the hardness at the front surface of the belt body, and the hardness at the rear surface of the belt body after heated is markedly higher than the hardness at the rear surface of the unheated belt body (see Table 7 and FIG. 9). More specifically, the hardness at the front surface of the belt body after the heat treatment at 350° C. for 2 hours is markedly higher than the hardness at the front surface of the unheated belt body, and the hardness at the rear surface of the belt body after the heat treatment at 350° C. for 2 hours is markedly higher than the hardness at the rear surface of the unheated belt body.

Test 2

Figure 3:
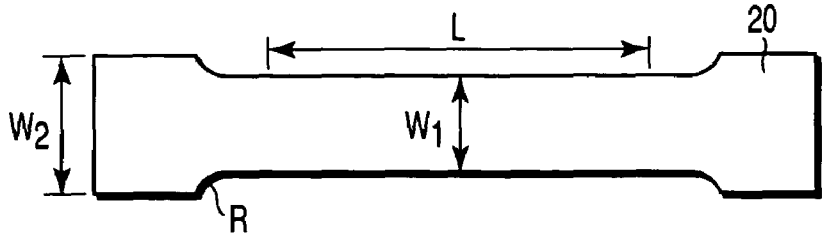
FIG. 3 is a plan view illustrating the test piece used in an evaluation test for a belt body.

In order to confirm that the durability of the belt body is improved unless the hardness at the rear surface of the belt body is not lowered to a level lower than the hardness at the front surface, test pieces 20 shown in FIG. 3 were taken from the three belt bodies of Examples 3 and 5 and Comparative Example 1, on which a durability test was conducted. Each tensile strength test piece 20 had the same shape and dimension as No. 13B test piece defined in JIS Z 2201 and an INSTRON 8871 system manufactured by INSTRON INC. was used as the tester. The size of each portion of the test piece 20 was as shown below:

Width $W_1$ of parallel portion: 12.5 mm;

Length L of parallel portion: 60 mm;

Radius R of shoulder portion: 20 mm;

Width $W_2$ of gripping portion: 20 mm

The conditions for the durability test were as shown below:

Repeating maximum stress: 700 N/mm$^2$;

Repeating minimum stress: 80 N/mm$^2$

Figure 10:
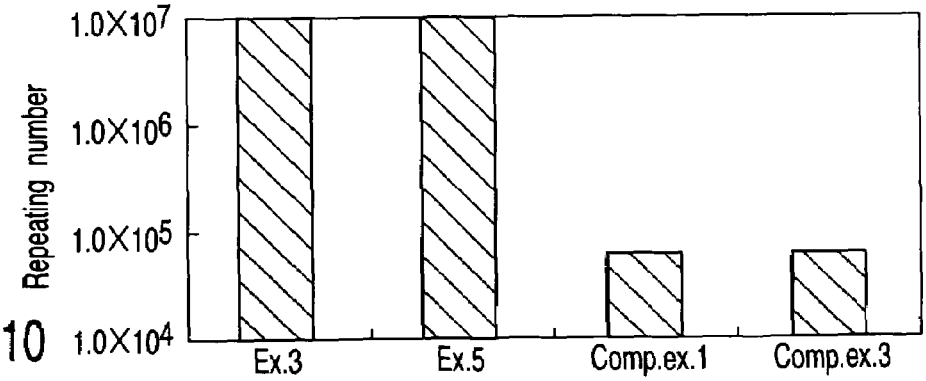
FIG. 10 shows the characteristics relating to the resistance to the thermal fatigue in respect of the belt body of each of Examples 1 to 5 and Comparative Examples 1 to 3, which are described herein later in detail.

Ambient temperature: 250° C.;

Repeating period: 15 Hz;

The results of the fatigue test (the number of times of repetition) for the belt bodies of Examples 3 and 5 and Comparative Examples 1 and 3 were as shown in Table 8 and FIG. 10. As shown in Table 8 and FIG. 10, the number of times of repetition (durability) in the thermal fatigue test was 60,000 times for the belt body of Comparative Example 1, and 60,000 times for the belt body of Comparative Example 3. On the other hand, the belt bodies of Examples 3 and 5 of the present invention were not broken, even if the fatigue test was repeated 10,000,000 times or more. The results clearly support that a belt body of a fixing belt can be obtained, which exhibits a high durability that cannot be found in the prior art, by preventing the hardness at the rear surface of the belt body from being lowered by the thermal deterioration.

TABLE 8

Results of Fatigue Test

| Belt Body | Number of times of repetition at 700 N/mm$^2$ |
|---|---|
| Example 3 | 10,000,000 times or more |
| Example 5 | 10,000,000 times or more |
| Comp. Ex. 1 | 60,000 times |
| Comp. Ex. 3 | 60,000 times |

As described above, according to the present invention, it is possible to obtain a belt body having a high durability, which permits preventing the thermal deterioration and also permits improving the fatigue characteristics at high temperatures, by setting the hardness at the front surface and the rear surface of the belt body to meet the relationship described above.

The present invention is not limited to the embodiment described above and can be worked by modifying the constituting factors of the present invention in the working stage not to deviate from the subject matter of the present invention. Also, various inventions can be achieved by combining appropriately a plurality of constituting factors of the present invention disclosed in the present specification in conjunction with the embodiment of the present invention. For example, it is possible to delete some constituting factors from all the constituting factors disclosed in each embodiment of the present invention. Further, it is possible to combine appropriately some constituting factors relating to different embodiments of the present invention.

What is claimed is:

1. A fixing belt, comprising:

an endless belt body, the endless belt body being formed of electroformed nickel, having a front surface and a rear surface, and exhibiting hardness higher at the rear surface than at the front surface after heated at 350° C. for 2 hours, wherein the fixing belt fixes a toner image on a recording medium, and wherein the belt body contains phosphorus in an amount larger in the rear surface region than in the front surface region.

2. The fixing belt according to claim 1, wherein the belt body contains phosphorus at a content smaller than 0.4 mass %.

3. The fixing belt according to claim 1, further comprising at least a releasing layer provided on the front surface of the belt body.

4. A fixing belt, comprising:

an endless belt body, the endless belt body being formed of electroformed nickel, having a front surface and a rear surface, and exhibiting hardness higher at the rear surface than at the front surface, wherein a difference in hardness between the front surface and the rear surface, after heated to at least 300° C. for two hours, is larger than a difference in hardness between the front surface and the rear surface of the belt body after heated to at least 220° C. for two hours, wherein the fixing belt fixes a toner image on a recording medium, and wherein the belt body contains phosphorus in an amount larger in the rear surface region than in the front surface region.

5. The fixing belt according to claim 4, wherein the difference in hardness between the front surface and the rear surface of the belt body after heated at 300° C. is larger than the difference in hardness between the front surface and the rear surface of the belt body after heated at 220° C.

6. The fixing belt according to claim 4, wherein the difference in hardness between the front surface and the rear surface of the belt body after heated at 350° C. is larger than the difference in hardness between the front surface and the rear surface of the belt body after heated at 300° C.

7. The fixing belt according to claim 4, wherein the belt body contains phosphorus at a content smaller than 0.4 mass %.

8. The fixing belt according to claim 4, further comprising at least a releasing layer provided on the front surface of the belt body.

9. A fixing belt, comprising:

an endless belt body, the endless belt body being formed of electroformed nickel, having a front surface and a rear surface, and exhibiting hardness higher at the rear surface than at the front surface, wherein hardness of the front surface after heated is higher than before heating, and wherein the belt body contains phosphorus, wherein the fixing belt fixes a toner image on a recording medium, and wherein the belt body contains phosphorus in an amount larger in the rear surface region than in the front surface region.

10. The fixing belt according to claim 9, wherein the belt body contains phosphorus at a content smaller than 0.4 mass %.

11. The fixing belt according to claim 9, further comprising at least a releasing layer provided on the front surface of the belt body.

12. A fixing belt, comprising:

an endless belt body, the endless belt body being formed of electroformed nickel, having a front surface and a rear surface, and exhibiting hardness higher at the rear surface than at the front surface, wherein hardness of the rear surface after heated at 350° C. for two hours is higher than before heating, wherein the fixing belt fixes a toner image on a recording medium, and wherein the belt body contains phosphorus in an amount larger in the rear surface region than in the front surface region.

13. The fixing belt according to claim 12, wherein the belt body contains phosphorus at a content smaller than 0.4 mass %.

14. The fixing belt according to claim 12, further comprising at least a releasing layer provided on the front surface of the belt body.

15. A fixing belt for fixing a toner image on a recording medium, comprising:

an endless belt body, the endless belt body being formed of electroformed nickel, having a front surface and a rear surface, and exhibiting hardness higher at the rear surface than at the front surface after heated at 350° C., wherein the belt body contains phosphorus at a content smaller than 0.4 mass %.

16. A fixing belt for fixing a toner image on a recording medium, comprising:

an endless belt body, the endless belt body being formed of electroformed nickel, having a front surface and a rear surface, and exhibiting hardness higher at the rear surface than at the front surface, wherein a difference in hardness between the front surface and the rear surface, after heated, is larger than that between the front surface and the rear surface of the belt body before heating, and wherein the belt body contains phosphorous in an amount larger in the rear surface region than in the front surface region.

17. A fixing belt for fixing a toner image on a recording medium, comprising:

an endless belt body, the endless belt body being formed of electroformed nickel, having a front surface and a rear surface, and exhibiting hardness higher at the rear surface than at the front surface, wherein a difference in hardness between the front surface and the rear surface, after heated, is larger than that between the front surface and the rear surface of the belt body before heating, and wherein the belt body contains phosphorous at a content smaller than a 0.4 mass %.

* * * * *